US010461458B2

(12) United States Patent
Kim et al.

(10) Patent No.: US 10,461,458 B2
(45) Date of Patent: Oct. 29, 2019

(54) TERMINAL POSITION ASSURANCE DEVICE FOR ELECTRICAL CONNECTOR

(71) Applicant: J.S.T. CORPORATION, Farmington Hills, MI (US)

(72) Inventors: Jong Soo Kim, Naperville, IL (US); Gwen Upson, Ypsilanti, MI (US); Ping Chen, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/134,050

(22) Filed: Sep. 18, 2018

(65) Prior Publication Data

US 2019/0109399 A1 Apr. 11, 2019

Related U.S. Application Data

(60) Provisional application No. 62/568,455, filed on Oct. 5, 2017.

(51) Int. Cl.
*H01R 13/436* (2006.01)
*H01R 13/502* (2006.01)
(Continued)

(52) U.S. Cl.
CPC ..... *H01R 13/4362* (2013.01); *H01R 13/6275* (2013.01); *H01R 13/639* (2013.01); *H01R 13/502* (2013.01)

(58) Field of Classification Search
USPC ..... 439/752, 595
See application file for complete search history.

(56) References Cited

U.S. PATENT DOCUMENTS 5,299,958 A * 4/1994 Ohsumi ..... H01R 13/4362 439/752
5,890,935 A * 4/1999 Pill ..... H01R 13/4368 439/752

(Continued)

FOREIGN PATENT DOCUMENTS

KR 2011-0006766 U 7/2011

OTHER PUBLICATIONS

International Search Report of the International Searching Authority for International Application No. PCT/US2018/053320 dated Jan. 22, 2019 (4 sheets).

(Continued)

*Primary Examiner* — Gary F Paumen
(74) *Attorney, Agent, or Firm* — Kratz, Quintos & Hanson, LLP

(57) ABSTRACT

A terminal position assurance device (TPA) generally of a "C-shape" design which fits into a housing for an electrical connector, has two arms including a side portion and a ledge portion, and a back portion. The TPA arms flex such that housing breakage is limited. The inward facing surface of each ledge portion has a narrowly tapered shape. The corresponding housing used has a C-shape opening similarly shaped to the TPA. The TPA has stops that engage the housing such that the TPA device can be inserted into the housing at preset and full-lock positions and will not eject out. At a full-lock position, the TPA fully resides in the housing opening completely. The TPA also has associated pads that reduce associated noise with the housing when it is in service.

18 Claims, 7 Drawing Sheets

(51) Int. Cl.
*H01R 13/627* (2006.01)
*H01R 13/639* (2006.01)

(56) References Cited

U.S. PATENT DOCUMENTS

| | | | | |
|---|---|---|---|---|
| 6,171,150 | B1 * | 1/2001 | Saito | H01R 9/0512 439/607.51 |
| 9,843,126 | B1 * | 12/2017 | Irish | H01R 13/4362 |
| 2004/0190986 | A1 | 9/2004 | Hara | |
| 2006/0063414 | A1 * | 3/2006 | Goto | H01R 13/4223 439/298 |
| 2007/0093131 | A1 * | 4/2007 | Takahashi | H01R 13/4361 439/595 |
| 2012/0214358 | A1 | 8/2012 | Takahashi | |
| 2015/0024639 | A1 * | 1/2015 | Matsumura | H01R 13/4362 439/744 |
| 2015/0200492 | A1 | 7/2015 | Endo | |
| 2017/0170601 | A1 * | 6/2017 | Chen | H01R 13/639 |
| 2018/0301842 | A1 * | 10/2018 | Somanathapura Ramanna | H01R 13/4367 |

OTHER PUBLICATIONS

Written Opinion of the International Searching Authority for International Application No. PCT/US2018/053320 dated Jan. 22, 2019 (8 sheets).

* cited by examiner

TERMINAL POSITION ASSURANCE DEVICE FOR ELECTRICAL CONNECTOR

CROSS-REFERENCE TO RELATED APPLICATIONS

This application claims priority of U.S. provisional application No. 62/568,455, filed Oct. 5, 2017.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention generally relates to the field of electrical connectors, which are useful in automotive applications.

Description of the Related Art

Terminal Position Assurance (TPA) devices are used in electrical connectors to insure that terminals are properly seated in a connector housing. Typically, the TPA device takes the form of a pin or key inserted into a connector housing, and is designed such that the TPA device cannot be fully inserted unless the terminal are properly seated in the terminal cavities of the housing.

In some TPA designs, the TPA device is designed with stops that engage the housing, such that the TPA device can be inserted to a preset position that will not fall out of the housing. After insertion of the terminals into the terminal cavity, the TPA device can then be pushed to the full-lock position. In many designs, the TPA device is designed to push a wall of the housing outward when the TPA device is inserted, so as to secure the position of the terminal. However, it is possible for the housing wall to be over-flexed during the insertion process, leading to breakage of the housing wall.

BRIEF SUMMARY OF THE INVENTION

A terminal position assurance device (TPA) which includes a back portion having two outer ends, and two arms extending from the two outer ends generally perpendicularly to the inner surface of the back portion to form a C-shape. Each arm comprises a side portion having a thickness and a ledge portion extending along an upper portion of the side portion. Each arm also has an outer surface defined by outer portions the side portion and ledge portion. The thickness of the ledge portion where it meets the back portion is greater than the thickness of the ledge portion at the end of the arm which creates a narrowly tapered ledge shape. The thickness of the arm at each ledge is greater than the thickness of the side portion, thus creating the ledge structure. Stops are located on the outer surface of the arm and serve to engage a portion of a connector housing so as to allow the TPA device to remain in preset or full-lock position respectively with a housing. The arms flex such that the TPA can insert into the opening of a connector housing. Pads/Protrusions on the back portion of the TPA reduce associated noise of with a connector housing when in service.

An electrical connector housing of the invention has a top wall and side walls. The electrical connector also has a front wall having cavities for receiving electrical terminals. Top wall of the housing has a C-shape opening for receiving a terminal position assurance (TPA) device. The opening is C-shaped and designed to fit the C-shape of a corresponding TPA device, and the opening edge includes a lip structure to engage the stops on a TPA device.

DETAILED DESCRIPTION OF THE INVENTION

The present invention provides a Terminal Position Assurance (TPA) device and an electrical connector housing of an electrical connector.

Figure 1:
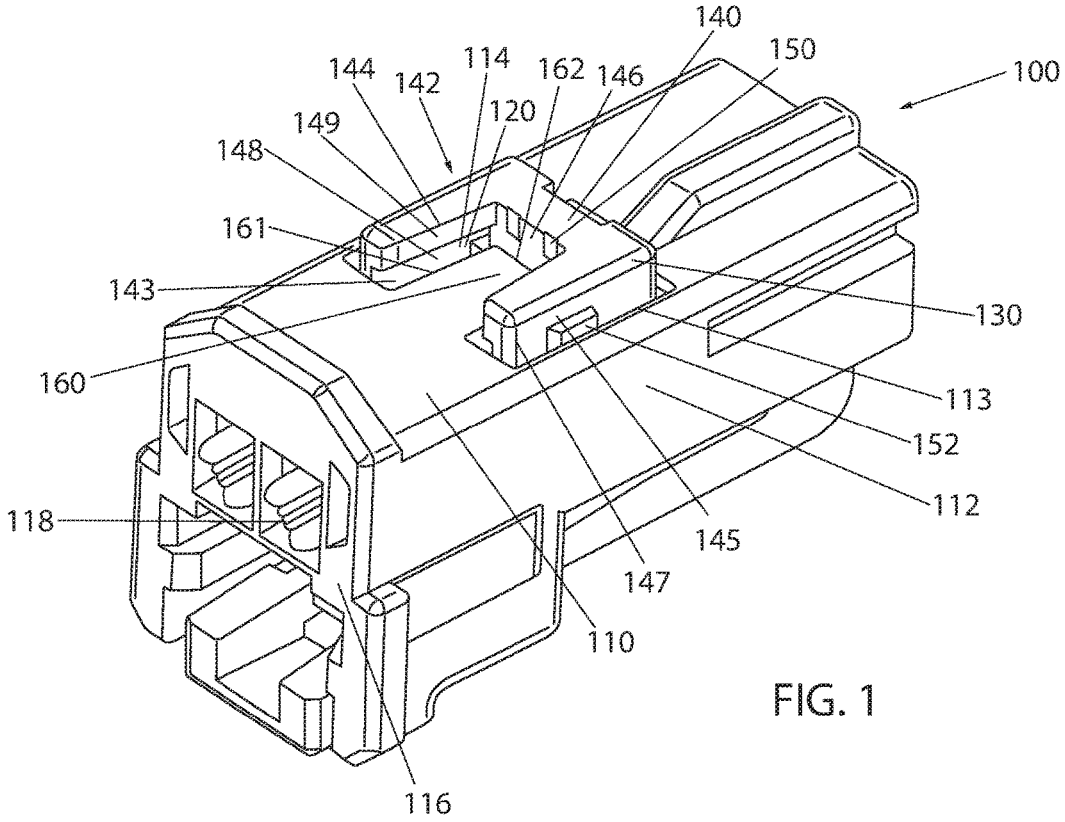
FIG. 1 is a perspective view of the Terminal Housing showing the Terminal Position Assurance device inserted in a preset position, in accordance with the invention.

As shown in FIG. 1, an electrical connector housing 100 of the invention has top wall 110 and side walls 112. Electrical connector 100 also has front wall 116 having cavities 118 for receiving electrical terminals.

Top wall 110 of housing 100 has a C-shape opening 120 for receiving a terminal position assurance (TPA) device 130. The C-shape opening 120 is similarly shaped and designed to fit the C-shape of TPA device 130.

FIG. 1 illustrates the TPA device 130 inserted into the housing 100 in the preset position. In this position, stops 151 (See FIG. 2) are below the top wall 110 and stops 152 rest on and above the top wall 110 of the housing 100. The stops are located at different heights on the outer surface of the arm 145 of the side portion 143. Stops 151, 152 extend outward from the outer surface 145 of each arm 142 and serve to engage a portion of the housing 100 so as to allow the TPA device 130 to remain in preset or full-lock position in the housing 100 respectively. The opening edges 113 of the housing 100 have a lip under the top wall 110 for engaging stops 151, 152. Such lip structures are well known in the art and are not illustrated here. As can be seen, the insertion of TPA device 130 further into the housing 100 presses stops 152 against the opening edges 113 of top wall 110, thereby exerting outward force on side walls 112.

Figure 2:
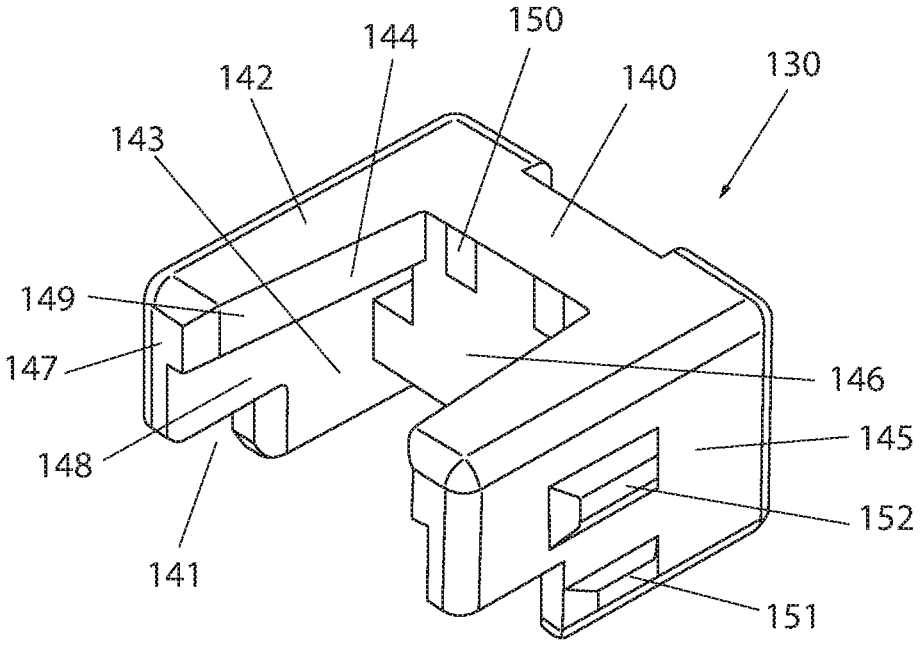
FIG. 2 is a perspective view of the Terminal Position Assurance device of this invention.

As shown in more detail in FIG. 2, TPA device 130 has back portion 140 and two arms 142, extending from opposite ends of the back portion 140 and oriented generally perpendicular (see FIG. 3A) to the back portion 140, thereby forming the "C-shape". The two arms 142 may be mirror images of each other. Each arm 142 includes a side portion 143 and a ledge portion 144. The outer surface 145 of each arm 142 is defined by the outer portions of the side portion 143 and ledge portion 144 respectively. In the embodiment illustrated in FIG. 2, side portions 143 each have notch 141 to avoid contact with interior portions of the housing. The side portion 143 is also generally of a uniform thickness. The ledge portion 144 extends along an upper portion of the side portion 143. The thickness of the ledge portion 144 is greater than the thickness of the side portion 143 and thus creates a ledge structure. Additionally, the ledge portion 144 has a narrowly tapered shape, with the inward facing surface 149 narrowly tapering from where the ledge 144 meets back portion 140 to where the ledge 144 meets the end of the arm 147, with a decrease in thickness of the ledge portion 144 toward the end of each arm 147.

Figure 3A:
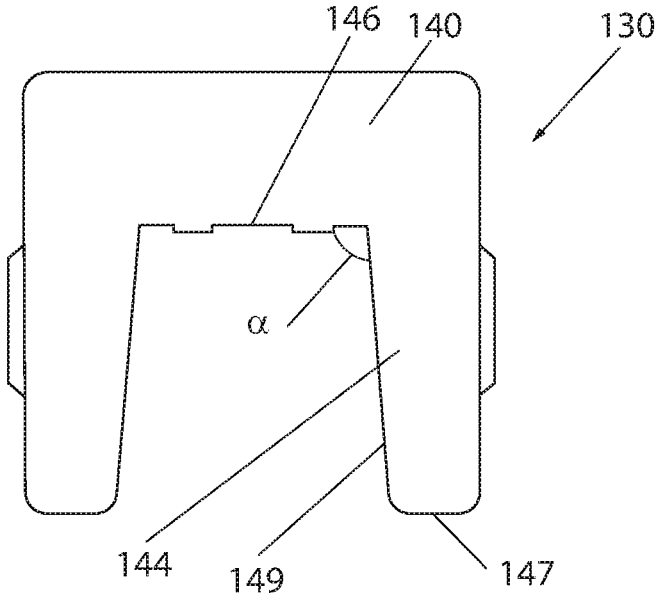
FIGS. 3A, B, are top views of a simplified version of a Terminal Position Assurance device and a Housing Opening respectively, in accordance with the invention.

As further illustrated in FIG. 3A, the inward facing surface 149 of ledges 144 narrowly tapers from where the ledge 144 meets back portion 140 to where the ledge 144 meets the end of the arm 147; wherein the inward facing surface 149 is predominately straight. The inward facing surface 149 of each ledge 144 meets the inward facing surface 146 of the back portion 140 at an angle α in the range of greater than 90° to less than or equal to 105°, for example, it may be 91°, 93°, 95°, 97°, 99°, 101° or 103°.

Figure 3B:
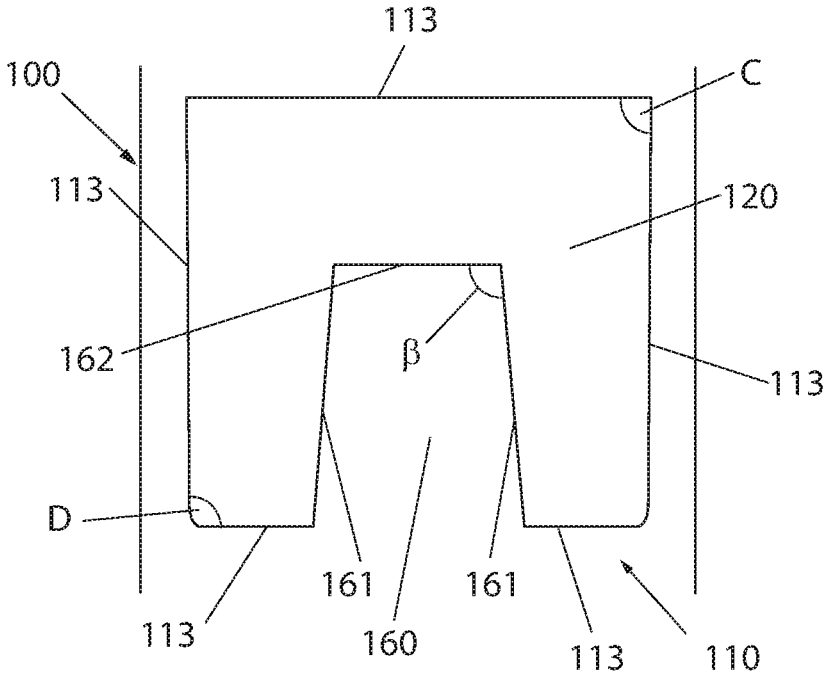

FIG. 3B is a top view of the C-shape opening 120, in top wall 110, of housing 100 which is similarly shaped to TPA device 130. The C-shape opening 120 is defined by opening edge 113, and a non-rectangular tongue portion 160 comprised of side facing edges 161, and a back facing edge 162 in the region of the top wall 110 corresponding to the open portion of the C-shape TPA 130. The portions of the opening edge 113 meet at angles C and D, and may be perpendicular. Further, the back facing edge 162 and each of side facing edges 161 meet at an angle β in the range of greater than 90° to less than or equal to 105°, for example, it may be 91°, 93°, 95°, 97°, 99°, 101° or 103°.

Figure 4A:
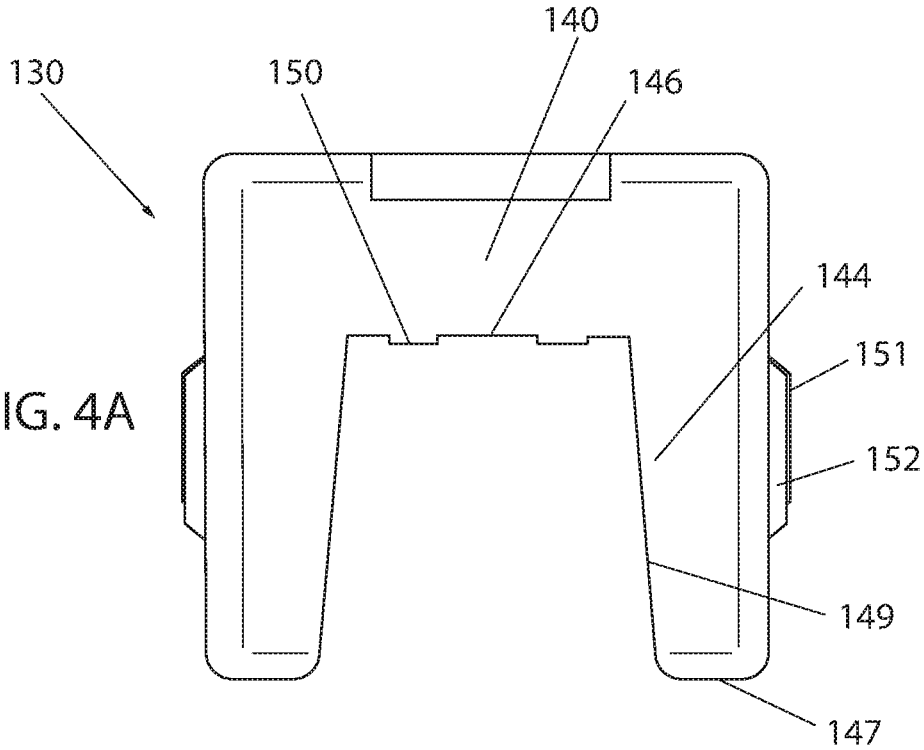
FIGS. 4A, B, are top views of the Terminal Position Assurance device in flexed and unflexed orientations respectively, in accordance with the invention.
Figure 4B:
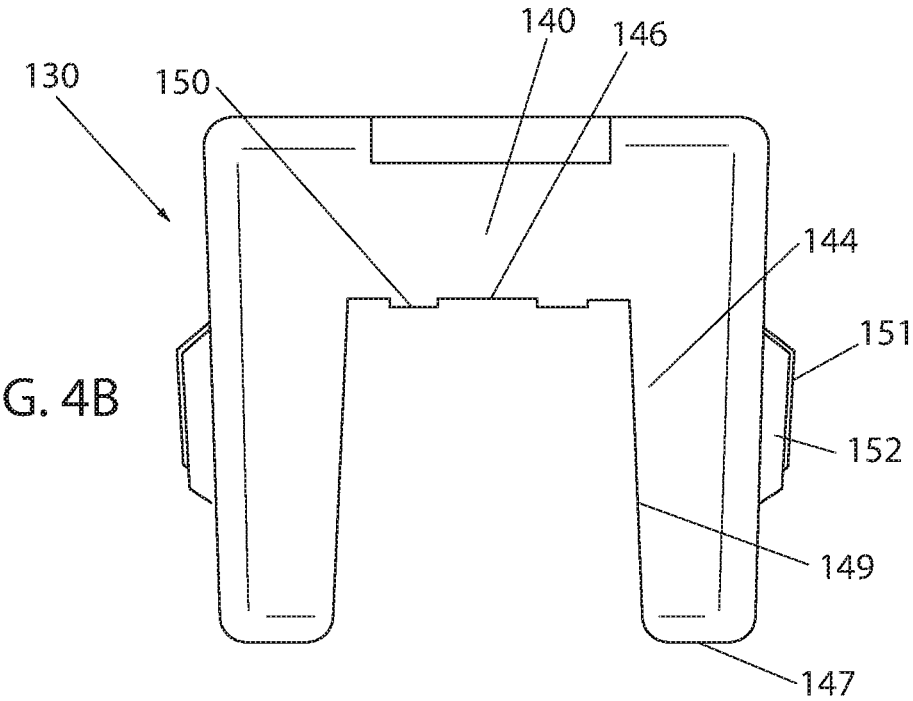

During the process of inserting TPA device 130 into housing 100, stops 151 and 152 are pressed by the opening edges 113 of the housing 100, and arms 142 are therefore squeezed inward toward the side facing edges 161 of the non-rectangular tongue portion 160. FIGS. 4A, B illustrate the C-shape and flex of the TPA device 130. FIG. 4A illustrates the TPA device 130 in an unflexed orientation in the preset or full-lock position. FIG. 4B illustrates the TPA device 130 in an inwardly flexed orientation during insertion.

Figure 5A:
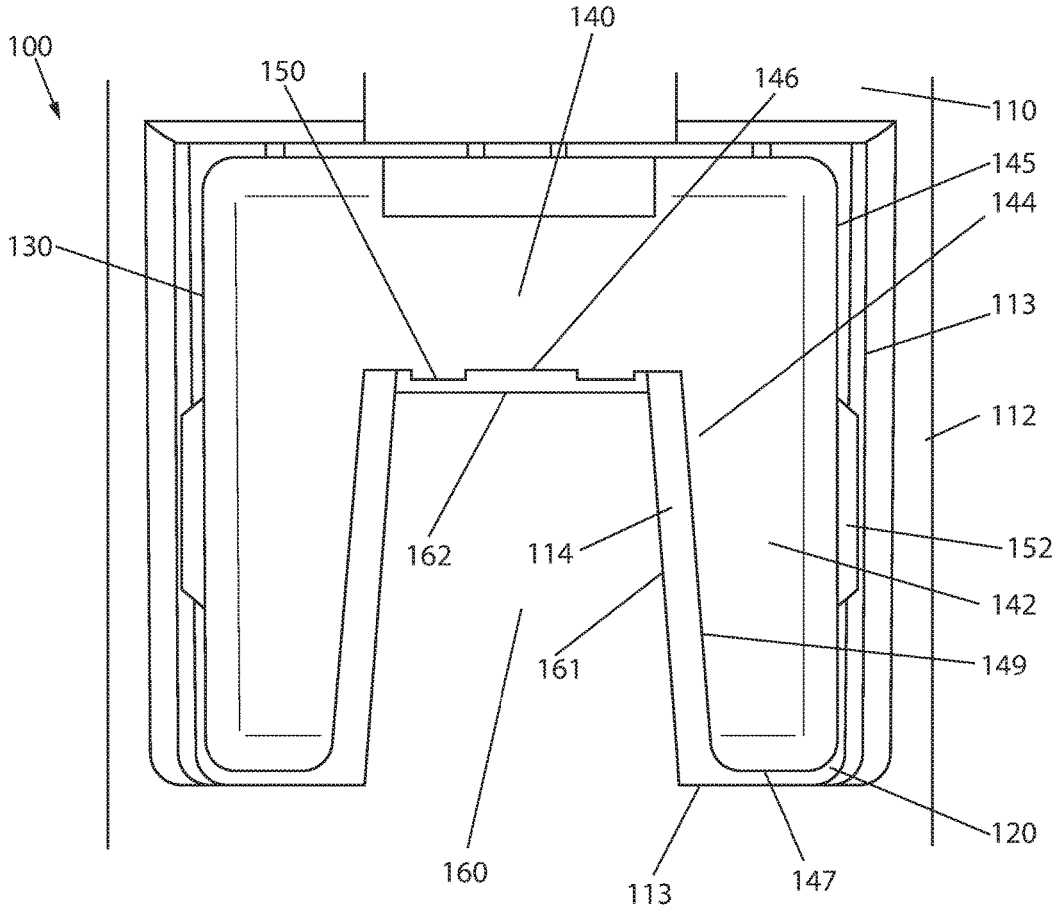
FIGS. 5A, B, C, are top views of a Terminal Housing and Terminal Position Assurance device set in a preset, insertion, and full-lock position respectively, in accordance with the present invention.

Moreover, FIGS. 5A, B, C illustrate interaction of the TPA device 130 with housing 100 at preset, insertion, and full-lock respectively. FIG. 5A shows the TPA device 130 inserted into the housing 100 in a preset position. Stops 151 (see FIG. 2) are below the top wall 110 of the housing 100 and stops 152 are above the top wall. Within the C-shape opening 120 is a gap area 114 between each arm 142, and side facing edge 161 of tongue portion 160 respectively. As further shown in FIG. 1, when TPA 130 is in a preset position, each of the respective side portions 143 of arms 142 are directly facing and opposing the side facing edges 161 of tongue portion 160 with gap areas 114 there between.

Figure 5B:
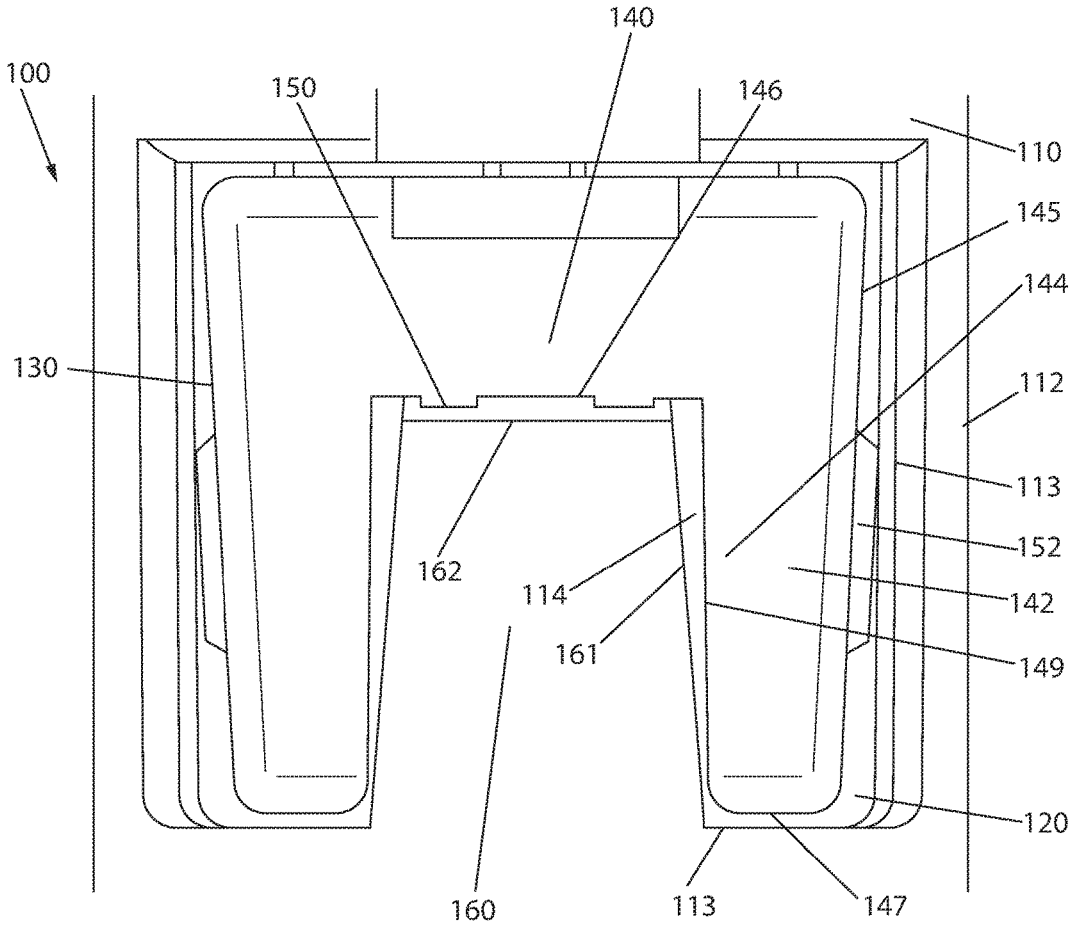

As seen in FIG. 5B, the arms 142 flex inward when second stops 152 press against the opening edges 113 during the insertion process. During the movement of the TPA 130 from preset to full-lock, arms 142 flex inward toward the side facing edges 161 of tongue portion 160 and into each gap area 114 respectively. Further, angle α in FIG. 3A, and angle β in FIG. 3B, typically have similar values such that the TPA 130 will insert and fit into C-shape opening 120 without interaction with the tongue portion 160.

As FIG. 5B illustrates, the gap area 114 provides adequate space such that the TPA 130 will flex and insert further into the housing 100 to allow stops 152 to enter the C-shape opening 120. Additionally, the housing 100 and TPA device 130 are designed so that during insertion, the arms 142 of TPA device 130 flex inward such that the outward flexing of side walls 112 is less than the depth of stops 151 or 152. The flexing in arms 142 of the TPA device 130 therefore results in less flexing of the side walls 112 of housing 100 than if there was no flexing in arms 142, limiting the side walls 112 from being over-flexed and leading to breakage.

Figure 5C:
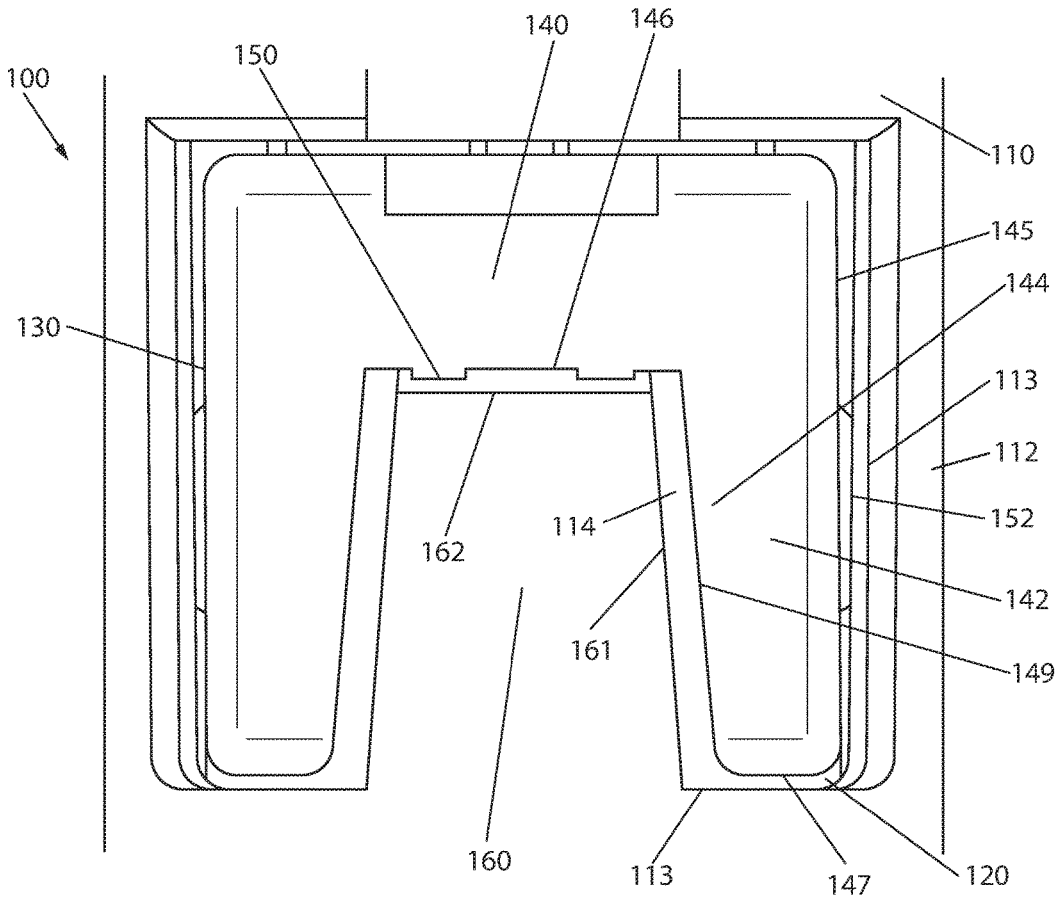

As illustrated in FIG. 5C, at a full-lock position, the TPA is fully inserted into the housing 100 wherein the TPA 130 resides in the C-shape opening 120 completely. Ledges 144 of arms 142 reside in the C-shape opening 120 and stops 152 are below the top wall 110 of the housing 100. The inward facing surfaces 149 of ledges 144 are directly facing and opposing to the side facing edges 161 of tongue portion 160, with the gap area 114 there between in a full-lock position. The distance arms 142 can flex inward into the gap area 114 is decreased wherein the stops 152 being below the top wall 110 do not eject from the housing during operation. As further shown in the embodiment of FIG. 5C, the side facing edges 161 of tongue portion 160 match the straightness and the narrow taper of the inward facing surface 149 of ledges 144, such that the gap area 114 represents a uniformly parallel space. The back facing edge 162 matches the straightness of the inward facing surface 146 of back portion 140. Further, the opening edges 113 match the straightness of the outer surface 145 of each arm 142 and the end 147 of each arm 142 respectively.

Further illustrated in FIG. 2 are pads/protrusions 150 on the TPA device 130. The pads/protrusions 150 are attached to an upper portion of inward facing surface 146 of back portion 140 of TPA device 130. As seen in FIG. 5C, pads/protrusions 150 are directly facing and opposing the back facing edge 162 of tongue portion 160 and inward facing surface 146 of back portion 140 when TPA device 130 is at a full-lock position. The back facing edge 162 of tongue portion 160, the inward facing surface 146 of back portion 140, and the pads/protrusions 150 thereof, match the straightness of each other. In a full-lock position, the pads/protrusions 150 minimize the distance between the back facing edge of the tongue portion 160 and the inward facing surface of the back portion 140, such that they reduce associated noise with the housing 100 when it is in service.

LIST OF REFERENCE NUMERALS

100 Electrical connector housing
110 Top wall of housing
112 Side Walls of housing
113 Opening Edge
114 Gap Area
116 Front wall of housing
118 Cavities
120 C-shape Opening in top wall of housing
130 Terminal position assurance (TPA) device
140 Back Portion of TPA
141 Notch
142 Arm

143 Side Portion
144 Ledge Portion
145 Outer Surface of Arm
146 Inward Facing Surface of Back Portion
147 End of Arm
148 Inward Facing Surface of Side Portion
149 Inward Facing Surface of Ledge Portion
150 Pads/Protrusions
151, 152 Stops
160 Non-Rectangular Tongue Portion
161 Side Facing Edge of Tongue Portion
162 Back Facing Edge of Tongue Portion
α Angle
β Angle
C Angle
D Angle

The invention claimed is:

1. A terminal position assurance device, comprising:
a back portion having two ends and an inner surface; and
two arms extending generally perpendicularly from the two ends of the back portion to form a C-shape with the back portion;
wherein each arm comprises:
a side portion having a thickness; and
a ledge portion extending along an upper portion of the side portion, wherein the thickness of the ledge is greater than the thickness of the side portion; and
an outer surface of the arm defined by outer surfaces of the side portion and ledge portion;
wherein the thickness of the ledge portion where it meets the back portion is greater than the thickness of the ledge portion at the end of the arm; and
a first stop located on the outer surface of the arm.

2. The terminal portion assurance device of claim 1, wherein:
the inward facing surface of each ledge is generally straight; and
the angle defined where the inward facing surface of each ledge meets the inner surface of the back portion is in the range of greater than 90° to less than or equal to 105°.

3. The terminal assurance device of claim 1, wherein each arm further comprises:
a second stop located on the outer portion of the arm,
wherein the first stop and second stop are located at different heights on the outer surface of the arm, below the upper portion of the side portion.

4. The terminal assurance device of claim 1, further comprising:
a protrusion on the inner surface of the back portion.

5. A terminal housing, comprising:
a top wall;
side walls connected to the top wall; and
a front wall connected to the top wall and the side walls, the front wall having at least one cavity for receiving an electrical terminal;
wherein the top wall has a C-shaped opening;
wherein the C-Shaped opening is generally rectangular in shape with a tongue portion extending into the rectangular shape,
wherein the tongue portion is defined by two side facing edges and a back facing edge and the angle between each side facing edge and the back facing edge is in the range of greater than 90° and less than or equal to 105°.

6. The terminal housing according to claim 5,
wherein the opening edges of the housing have a lip under the top wall for engaging stops on a terminal position assurance device.

7. The terminal housing according to claim 5 further comprising:
a terminal position assurance device inserted into the C-shaped opening of the terminal housing, said terminal position assurance device comprising:
a back portion having two ends and an inner surface; and
two arms extending generally perpendicularly from the two ends of the back portion to form a C-shape with the back portion;
wherein each arm comprises:
a side portion having a thickness; and
a ledge portion extending along an upper portion of the side portion, wherein the thickness of the ledge is greater than the thickness of the side portion; and
an outer surface of the arm defined by outer surfaces of the side portion and ledge portion;
wherein the thickness of the ledge portion where it meets the back portion is greater than the thickness of the ledge portion at the end of the arm; and
a first stop located on the outer surface of the arm.

8. The terminal housing according to claim 7, further comprising:
a lip on the opening edges of the housing under the top wall for engaging stops on the terminal position assurance device;
wherein the first stop of the terminal position assurance device is below the lip of the housing.

9. The terminal housing according to claim 8, further comprising:
a second stop located on the outer portion of the arm of the terminal position assurance device above the first stop,
wherein the second stop of the terminal position assurance device is located above the lip of the housing.

10. The terminal housing according to claim 7, further comprising:
a lip on the opening edges of the housing under the top wall for engaging stops on a terminal position assurance device; and
a second stop located on the outer portion of the arm of the terminal position assurance device above the first stop,
wherein the second stop of the terminal position assurance device is located below the lip of the housing.

11. The terminal housing according to claim 7, further comprising:
the inward facing surface of each ledge is generally straight; and
the angle defined where the inward facing surface of each ledge meets the inner surface of the back portion is in the range of greater than 90° to less than or equal to 105°.

12. The terminal housing according to claim 8, further comprising:
the inward facing surface of each ledge is generally straight; and
the angle defined where the inward facing surface of each ledge meets the inner surface of the back portion is in the range of greater than 90° to less than or equal to 105°.

13. The terminal housing according to claim 9, further comprising:

the inward facing surface of each ledge is generally straight; and the angle defined where the inward facing surface of each ledge meets the inner surface of the back portion is in the range of greater than 90° to less than or equal to 105°.

14. The terminal housing according to claim 10, further comprising:

the inward facing surface of each ledge is generally straight; and the angle defined where the inward facing surface of each ledge meets the inner surface of the back portion is in the range of greater than 90° to less than or equal to 105°.

15. The terminal housing according to claim 7, further comprising:

a protrusion on the inner surface of the back portion.

16. The terminal housing according to claim 8, further comprising:

a protrusion on the inner surface of the back portion.

17. The terminal housing according to claim 9, further comprising:

a protrusion on the inner surface of the back portion.

18. The terminal housing according to claim 10, further comprising:

a protrusion on the inner surface of the back portion.

* * * * *